US012157649B2

(12) United States Patent
Heege

(10) Patent No.: US 12,157,649 B2
(45) Date of Patent: Dec. 3, 2024

(54) METHOD AND APPARATUS FOR GUIDING A WEB TO A CENTRATION POINT

(71) Applicants: ONTEX BV, Buggenhout (BE); ONTEX GROUP NV, Erembodegem (BE)

(72) Inventor: Thomas Heege, Düngenheim (DE)

(73) Assignees: Ontex BV, Buggenhout (BE); ONTEX GROUP NV, Erembodegem (BE)

( * ) Notice: Subject to any disclaimer, the term of this patent is extended or adjusted under 35 U.S.C. 154(b) by 264 days.

(21) Appl. No.: 17/775,251

(22) PCT Filed: Nov. 3, 2020

(86) PCT No.: PCT/EP2020/080798
§ 371 (c)(1),
(2) Date: May 6, 2022

(87) PCT Pub. No.: WO2021/089535
PCT Pub. Date: May 14, 2021

(65) Prior Publication Data

US 2022/0388799 A1 Dec. 8, 2022

(30) Foreign Application Priority Data

Nov. 8, 2019 (EP) ..... 19208166

(51) Int. Cl.
*B65H 23/035* (2006.01)
*B65H 23/038* (2006.01)

(52) U.S. Cl.
CPC ..... *B65H 23/035* (2013.01); *B65H 23/038* (2013.01); *B65H 2301/3611* (2013.01); *B65H 2553/40* (2013.01)

(58) Field of Classification Search
CPC ..... B65H 23/035; B65H 23/038; B65H 2301/3611
See application file for complete search history.

(56) References Cited

U.S. PATENT DOCUMENTS 2,989,265 A 6/1961 Selsted
3,591,064 A * 7/1971 Wyatt ..... B65H 23/035 226/22

(Continued)

FOREIGN PATENT DOCUMENTS

DE 10022926 A1 11/2001
DE 102009014477 A1 9/2010

(Continued)

OTHER PUBLICATIONS

International Search Report and Written Opinion for PCT/EP2020/080798, mailed Dec. 9, 2020.

*Primary Examiner* — Sang K Kim
(74) *Attorney, Agent, or Firm* — VIVIVAR Law, PLLC

(57) ABSTRACT

The present invention relates to a method of guiding a web with a shifting path of the web to a substantially constant centration point. It comprises the steps of providing a web with a shifting path of the web from a source of the web, measuring upstream of said centration point, the position and/or orientation of said web by a sensor arrangement, and guiding said web to said centration point in accordance to the measurement results. The present invention advantageously relates to operations in the manufacturing of absorbent articles such as unwinding web rolls that are wound in a shifted manner, in particular spirally wound web rolls, and removing web from containers of loose web material. The invention also relates to a device for the execution of the method.

14 Claims, 5 Drawing Sheets

(56) References Cited

U.S. PATENT DOCUMENTS

| | | | | |
|---|---|---|---|---|
| 3,592,371 | A * | 7/1971 | Wyatt | B65H 23/035 28/282 |
| 4,212,422 | A | 7/1980 | Rauchfuss, Jr. et al. | |
| 5,031,848 | A | 7/1991 | Boeckmann | |
| 5,558,263 | A * | 9/1996 | Long | B65H 23/035 226/114 |
| 6,164,201 | A | 12/2000 | Burke | |
| 6,450,382 | B1 * | 9/2002 | Ohno | B65H 23/0204 226/22 |
| 7,073,747 | B2 * | 7/2006 | Weis | B65H 23/035 242/615.1 |
| 9,850,089 | B2 * | 12/2017 | Poisson | B65H 23/035 |
| 2001/0040178 | A1 | 11/2001 | Scharschinger et al. | |
| 2017/0050815 | A1 * | 2/2017 | Poisson | B65H 23/0204 |

FOREIGN PATENT DOCUMENTS

| | | | |
|---|---|---|---|
| EP | 1362815 | A2 | 11/2003 |
| SE | 510734 | C2 | 6/1999 |
| WO | 2015195132 | A1 | 12/2015 |

* cited by examiner

METHOD AND APPARATUS FOR GUIDING A WEB TO A CENTRATION POINT

CROSS-REFERENCE TO RELATED APPLICATIONS

This application is the national stage application of corresponding international application number PCT/EP2020/080798, filed Nov. 3, 2020, which claims priority to and the benefit of European application no. 19208166.9, filed Nov. 8, 2019, which is hereby incorporated by reference in its entirety.

DESCRIPTION

Technical Field

The present invention relates to a method of guiding a web with a shifting path of the web to a substantially constant centration point. In particular the present invention relates to operations in the manufacturing of absorbent articles such as unwinding web rolls that are wound in a shifted manner, in particular spirally wound web rolls, and removing web from containers of loose web material. The invention also relates to a device for the execution of the method.

Background

Webs for the production of hygiene products like diapers usually consist of flexible materials and are transported loosely in containers or as web rolls wound in a shifted manner. The weight of such a web roll, which can have the length of a multitude of the webs width, or such a container is usually more than 50 kg. A special technical problem lies with unwinding the web rolls respectively lies with removing web material from the container for further processing.

Web guiding systems for the control and the adjustment of the path of a web are well known in practice and are disclosed for example by DE102009014477A1, DE10022926C2 or EP1362815A2. They substantially consist of a guiding device comprising a sensor arrangement, an actuator and two parallel idler rollers where the web is lead around. Deviations from the optimal path of the web that for example can be caused by an upstream treatment process or errors in the winding of a web roll are measured by the sensor arrangement at the edges of the web. The measurement results are then translated into a pivoting motion of the idler rollers. The difference in orientation between the idler rollers and the web guided around them creates a transverse force on the web that will adjust the path of the web and bring it back to its optimal position. This way it is possible to correct even the slightest deviations of the path of the web. In order for these web guiding systems to work properly it is necessary for their pivoting axis to be positioned directly at or at least in close proximity to the idler roller at the entry side of the guiding device. Additionally, the sensor arrangement that measures the path of the web has to be placed downstream of the centration point which is located at the idler roller at the exit side of the guiding device. As these web guiding systems only measure and adjust the path of the web downstream of the centration point the width of the guiding device is a limiting factor for the maximum amount of deviation that can be adjusted. Likewise, the rotational movement of both idler rollers and the distance between them will increase the effective space taken by the guiding device even further. In practice these systems are therefore used to fine tune the path of the web rather than to handle unwinding operations with web rolls wound in a shifted manner or handling the removal of loose web materials from containers. Adjusting deviations of the path of the web in an amount of a multitude of the webs width would increase the dimensions of these systems to unpractical proportions.

U.S. Pat. No. 5,031,848A discloses a method and an apparatus for unwinding spirally wound web rolls comprising a web with a zipper track. With a guiding device the shifting path of the web is guided to the centration point that has a constant position in respect to the web roll. The guiding device is pivotably mounted at the centration point and comprises two parallel plates with just enough space between them to allow the web to slide through it and a guide track for the bulkier zipper part of the web. The guide track constantly becomes narrower over its way from the entry side of the guiding device to its exit side. The pivoting motions of the guiding device and the guiding effect on the web are caused by an exchange of forces between the zipper part of the web and the sides of the zipper guide track. In perpendicular direction the two plates prevent the web from moving out of the plane of the guiding device. In theory the principle could be applied to a web without a zipper track by guiding the whole of the web through a guiding track. The design of the guiding device as a passive element would however limit its application to highly durable web materials with a high compressive strength. Due to the necessary exchange of forces between the sides of the guide track and the edges of the web a flat web made of flexible materials such as textile, nonwoven or plastics would crease and wrinkle while passing the guiding device. Another problem of this approach is the necessity to position the guiding device in the same plane as the entering web to avoid additional friction at the edges of the plates.

SE510734C2 discloses a method and an apparatus for unwinding a web roll that is wound in a non-shifted manner and simultaneously winding the web in a shifted manner onto another carrier. The web roll to be unwound is placed on a trolley and positioned parallel to the other carrier. During unwinding the trolley oscillates between two points on a way in the length of the other carrier and in a constant distance to the other carrier. Because of the simultaneous winding of the web during unwinding the process creates a new web roll that is wound in a shifted manner. In between both webs rolls a constant tension of the web is maintained by a passive rod that can be pivoted and adjusted in height to avoid creasing and wrinkling. In practice this principle is commonly inverted to a pure unwinding operation for web rolls wound in a shifted manner. By oscillating the web roll during unwinding the shifting path of the web can be kept constantly aligned with the centration point. A very relevant disadvantage of this approach however lies with the need to accelerate, decelerate and accelerate the web roll again for each layer of the winding. The process therefore requires rather powerful actuators coming at high investment and operating costs. Additionally, the process requires lots of space as the web roll has to be moved more than double its length during unwinding.

Term Definitions

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

By the term "web" as used herein, is meant a flat sheet like material, in particular made of films and/or paper and/or textiles and/or nonwovens and/or super absorbent papers, that usually has a constant width and can be wound onto a carrier or loosely contained in a container.

By the term "super absorbent paper" as used herein, is meant for instance super absorbent-nonwoven (SA), super absorbent particle-nonwoven (SAP) or super absorbent fiber-nonwoven (SAF). The latter, SAF-nonwoven, can be a nonwoven substantially made from super absorbent fibers, or super absorbent fibers applied like a nonwoven. Furthermore, the SAF can be provided in a fibrous form (laminate) on its own (possibly supplemented with other fibers), or can be integrated within a different nonwoven fabric or in a spun yarn as a mixture of several substrates.

By the term "carrier" as used herein, is meant an object, in particular cardboard rolls of cylindrical form, on which a web can be wound and that acts as a stabilizing core for the winding.

By the term "web roll" as used herein, is meant a web that is wound lying flat on a carrier.

By the term "container" as used herein, is meant a container, for example a box, in which a web is loosely contained.

By the term "loosely contained" or "loosely contained in a container" as used herein, is meant that a web is contained in a container in a random, stacked, folded or otherwise aligned configuration or any combination of the listed configurations whereby the path of the web will shift while the web is removed from the container.

By the term "wound in a shifted manner" as used herein, is meant that over 60% of the windings of the web are angled to the transverse axis of the carrier by a constant or non-constant winding angle $\alpha$ ($\alpha>0°$), or, otherwise stated, are not parallel to the transverse axis of the carrier.

By the term "spirally" as used herein, is meant a winding wound in a shifted manner where over 60% of the windings of each layer have substantially inversed winding angles $\alpha$ with the windings of the layer directly above or beneath it and has substantially identical winding angles $\alpha$ with each second layer above or beneath it. It should be noted that the first layer of a winding wound in a shifted manner does not have a layer beneath it and the last layer does not have a layer above it.

By the terms "entry side" and "exit side" as used herein, is meant a location in relation to the path of the web. "Entry side" means as much as "at the side where the web enters" and "exit side" means as much as "at the side where the web exits".

By the term "shifting path of the web" or "shifted path of the web" as used herein, is meant that the longitudinal axis of the web potentially changes position and/or orientation within the plane defined by the edges of the web while it is unwound respectively while it is removed from a container and/or while it runs through a process. Additionally or alternatively, the web may be pivoted around the longitudinal axis and/or twisted.

By the term "linear path of the web" as used herein, is meant that the running web is substantially not pivoted and/or twisted around its longitudinal axis.

By the term "in orientation constant path of the web" as used herein, is meant that the path of the web substantially does not change orientation within the plane defined by the transversal edges of the web. In other words, the web does not change its angle in respect to any other constant reference axis.

By the term "longitudinal axis of the web" as used herein, is meant the axis that lies along the length of said web and at equal distance to the transversal edges of the web wherein any axis perpendicular to said longitudinal axis would define a transversal axis.

By the term "infeed point" as used herein, is meant a point where the web leaves the apparatus for unwinding a web roll that is wound in a shifted manner and enters a downstream process.

By the term "centration point" as used herein, is meant the substantially constant first point in the path of the web where the web will arrive no matter the original path. In other words, this means that the longitudinal axis of a web with a shifting path will cross the centration point regardless of its former or current orientation and/or the twisted state of the web and/or the pivoted state of the web. During operation the web can arrive at the centration point with an angle or no angle in respect to any other constant reference axis such as the transverse axis of a static web roll. Likewise, it may or may not be twisted and/or pivoted when arriving at the centration point. Of course, as with all technical processes an absolute precision is not achievable due to errors in the process or external factors. Slight deviations of the path of the web from its intended centration point may therefore occur.

SUMMARY OF THE INVENTION

The present invention has been made in view of the problems mentioned above and offers a way of unwinding web rolls wound in a shifted manner and remove loose web materials from containers by sensor-supported guidance of the web to a centration point that improves on the current state of art with lower operating and investment costs as well as lower requirements on the available space and the material strength of the web material.

This object is achieved by the method disclosed in the independent claim 1 and the apparatus disclosed in the independent claim 6.

Embodiments of the invention are disclosed in the dependent claims.

The present invention provides in a first aspect, a method of guiding a web with a shifting path of the web to a centration point comprising the steps of:

a. providing the web with a shifting path of the web from a source of the web, b. measuring the position and/or orientation of said web by a sensor arrangement, c. guiding said web to said centration point in accordance with the measurement results of step b, characterized in that said centration point has a substantially constant position in respect of the source of the web and in that the measurement of step b is conducted upstream of said centration point. The method may be applied to unwind web rolls wound in a shifted manner, in particular spirally wound web rolls, and/or to remove loose web from containers without requiring any oscillation of the web roll, container or centration point. The method may also be applied to unwind conical, dumbbell-shaped or otherwise unregularly wound web rolls as well as to remove web from a container that is contained in a random, stacked, folded or otherwise aligned configuration or any combination thereof. The sensor-supported and active guidance to a constant centration point according to the present invention may allow an easier adjustment of the path of the web without putting too much stress on the web material. As an additional advantage of the method, jumps and errors in the layers of the web roll or container may be corrected in a first coarse sensitivity adjustment.

A simple example of a sensor arrangement comprises two photoelectric sensors each comprising a light transmitter and a light receiver positioned in pairs on each of the transversal edges of the web respectively, as illustrated for example in FIG. 1, on the left and right side of the entry side of the guiding device. If the web crosses one of the sensors the light transmission will be interrupted and a correction signal will be sent. The guiding device then moves at a constant predefined speed in the direction of the interrupted sensor pair until the light transmission is restored. This approach however may come at the disadvantage that degree of shift in orientation of the web is not taken into account and the web might slip out of the entry side of the guiding device completely if the shift exceeds the constant moving speed of the guiding device. In order to solve this problem, it is possible to employ more than two photoelectric sensors such as four, six or eight sensors in sequence on each side. The moving speed of the guiding device may then be increased if more than one sensors light transmission is interrupted. Another option to solve this problem would be to use a well-known control scheme that adjust the moving speed of the guiding device by a P-, I-, PI- or PID-behavior. Depending on the properties of the web material, the type of sensor of the sensor arrangement may be chosen from a wide range of types. This includes sensors of the invisible light spectrum such as ultraviolet or infrared sensors, cameras or even ultrasonic or metal sensors. It is also possible to not only detect the edges of the web but also properties of the web itself such as print marks or graphics on the material in order to determine its orientation or position.

Preferably, said guiding of the web to the centration point is conducted by at least one guiding device, said at least one guiding device being pivotably mounted substantially at the centration point.

Preferably, the sensor arrangement measures the shifting path of the web upstream and/or downstream of the entry side of said guiding device. This may come at the benefit of a faster (upstream sensor) or slower (downstream sensor) reaction to any deviation in the path of the web which equally enables the processing of webs with a heavy or unstable shifting path of the web. For example, if the measurements are taken downstream of the entry side of the guiding device (and upstream of the centration point), the delay between occurrence of a shift and measurement of it may cause slower response times. For certain applications it may be more suitable to respond more slowly since the web may only shift for brief moments from its original path and readjust itself shortly thereafter. In the same sense it may be necessary to have a very fast reaction when the path of the web is heavily and consistently shifting. For other certain applications it may be suitable to take measurements upstream and downstream of the guiding device in order to have a fast response time and delayed controlling of the effect of the guiding operation.

Preferably, said shifting path of the web is adjusted to a substantially linear path of the web and to a substantially in orientation constant path of the web downstream of said centration point. Advantageously, this may allow a reliable infeed into a downstream follow-up process and/or an easier processing of the web in said downstream follow-up process.

Preferably, the source of the web is a web roll or container and said web comprises a material selected from the group of films, papers, textiles, nonwovens and super absorbent papers.

In a second aspect, the present invention provides an apparatus for guiding a web with a shifting path of the web from a source of the web to a centration point comprising a guiding device pivotably mounted substantially at a centration point, said centration point having a substantially constant position in respect of the source of the web, said guiding device being adapted to guide said web to said centration point by pivoting motions, characterized in that the pivoting of the guiding device is controlled by a control circuit, said control circuit comprising at least one actuator and a sensor arrangement that is located upstream of said centration point and in that said sensor arrangement measures the position and/or orientation of the web upstream of said centration point. During operation, the shifting path of the web may be measured upstream of the centration point by the sensor arrangement and the measurement results may be translated into a control signal for the actuator that causes the pivoting motions of the guiding device. The entry side of the guiding device may then follow the shifting path of the web keeping its entry portion constantly aligned with the longitudinal axis of the incoming web. The apparatus may have the advantage that the width of the guiding device has to be only slightly larger than the width of the web therefore reducing the amount of required space. Furthermore, the material costs for the guiding device may be reduced and it is possible to use an actuator of lower power. Because of the design of the apparatus with an active control circuit the required exchange of forces between the web and the guiding device to achieve the intended guiding effect may be reduced significantly. It is believed that the stress caused on the web may be minimized by this approach.

Preferably, the apparatus is adapted to guide the web downstream of the centration point in substantially perpendicular direction to an infeed point and the path of the web is adjusted to a substantially linear and in orientation constant movement downstream of said infeed point.

Preferably, at the infeed point a guiding element is mounted, preferably an idler roller or a rod, around which the web may be guided. Therefore, the stress through friction on the web at said infeed point may be reduced.

Preferably, the sensor arrangement measures the shifting path of the web at the entry side of the guiding device and/or between the guiding device and the web roll and/or at the web roll.

Preferably, the sensor arrangement is adapted to pivot around an axis at the entry side of the guiding element and, upstream of the sensor arrangement, at least one guiding element, preferably an idler roller or rod, is pivotably mounted. Even more preferably, said sensor arrangement and said pivotably mounted guiding element are mounted to the same pivoting frame. This embodiment has proven to be favorable since the efficiency of conventional sensors is usually reduced when measuring the path of the web while being angled to the plane defined by the edges of the web. A pivotable mounting of the sensor arrangement and a supporting guiding element may therefore allow a more flexible positioning of the apparatus in respect to the position of the web roll.

Preferably, the guiding device comprises at least two guiding elements, preferably at least two idler rollers or rods, of which one guiding element is mounted to the guiding device at its entry side and one guiding element is mounted to the guiding device at its exit side. This way, the stress through friction on the web while passing the guiding device may be reduced.

In an embodiment, at least one web guiding system for fine tuning of the path of the web is mounted downstream of the centration point. Depending on the sensitivity of a downstream process to smaller deviations of the path of the web adding additional ones of the traditional web guiding systems described in the background section above can be favorable.

Preferably, the web comprises a material selected from the group of films, papers, textiles, nonwovens and super absorbent papers.

Preferably, the guiding device for stabilization purposes comprises the means of being movably mounted on a holder.

Preferably, the actuator is powered hydraulically, electrically or pneumatically or by a combination of any one of these types.

BRIEF DESCRIPTION OF THE DRAWINGS

A particularly preferred embodiment of the present invention is illustrated by the following drawings.

DETAILED DESCRIPTION OF A PARTICULARLY PREFERRED EMBODIMENT

A particularly preferred embodiment of the present invention will now be described with reference to the figures.

Figure 1:
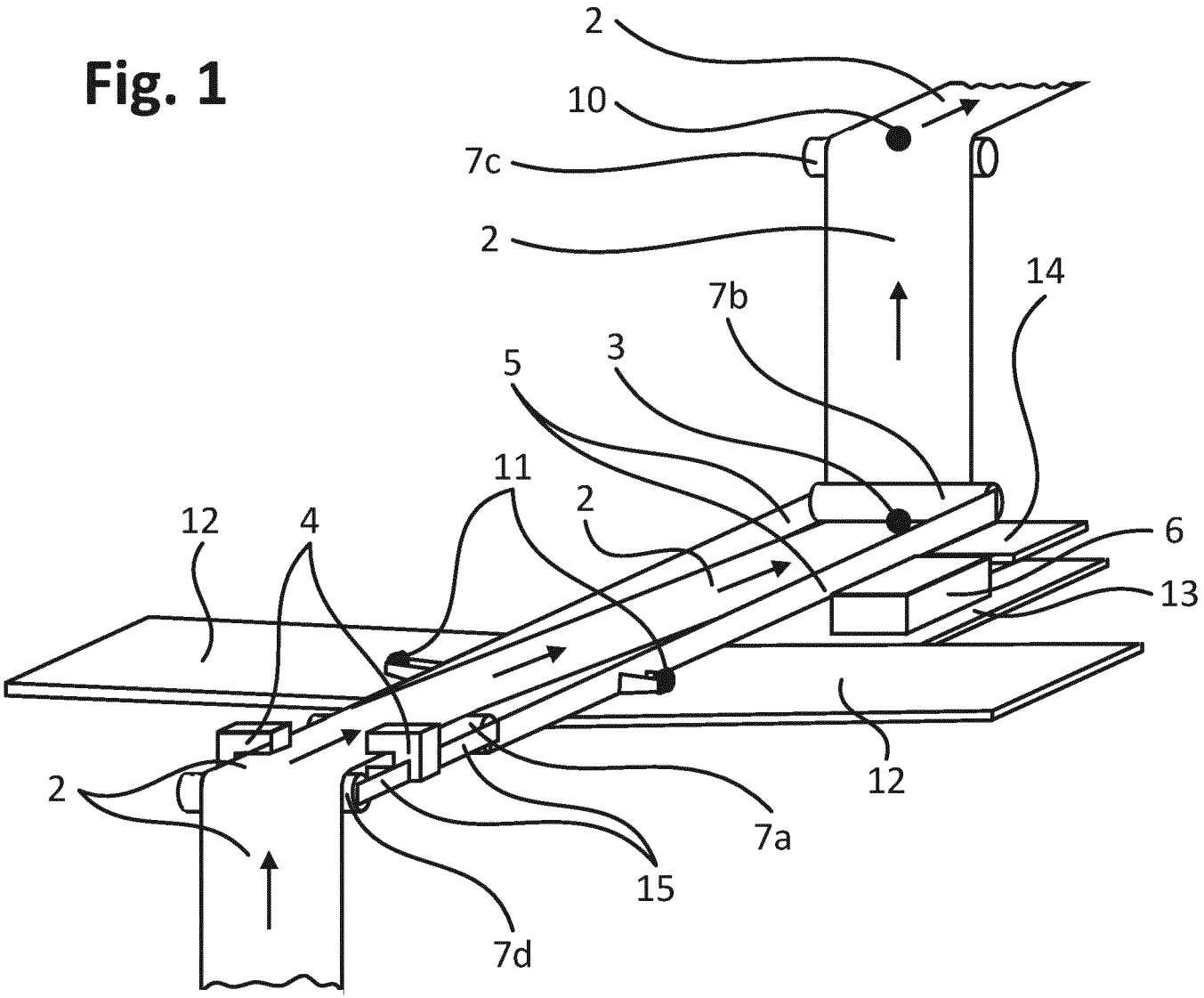
FIG. 1 is a schematic perspective view illustrating an apparatus for guiding a web with a shifting path of the web to a centration point according to the present invention.
Figure 2:
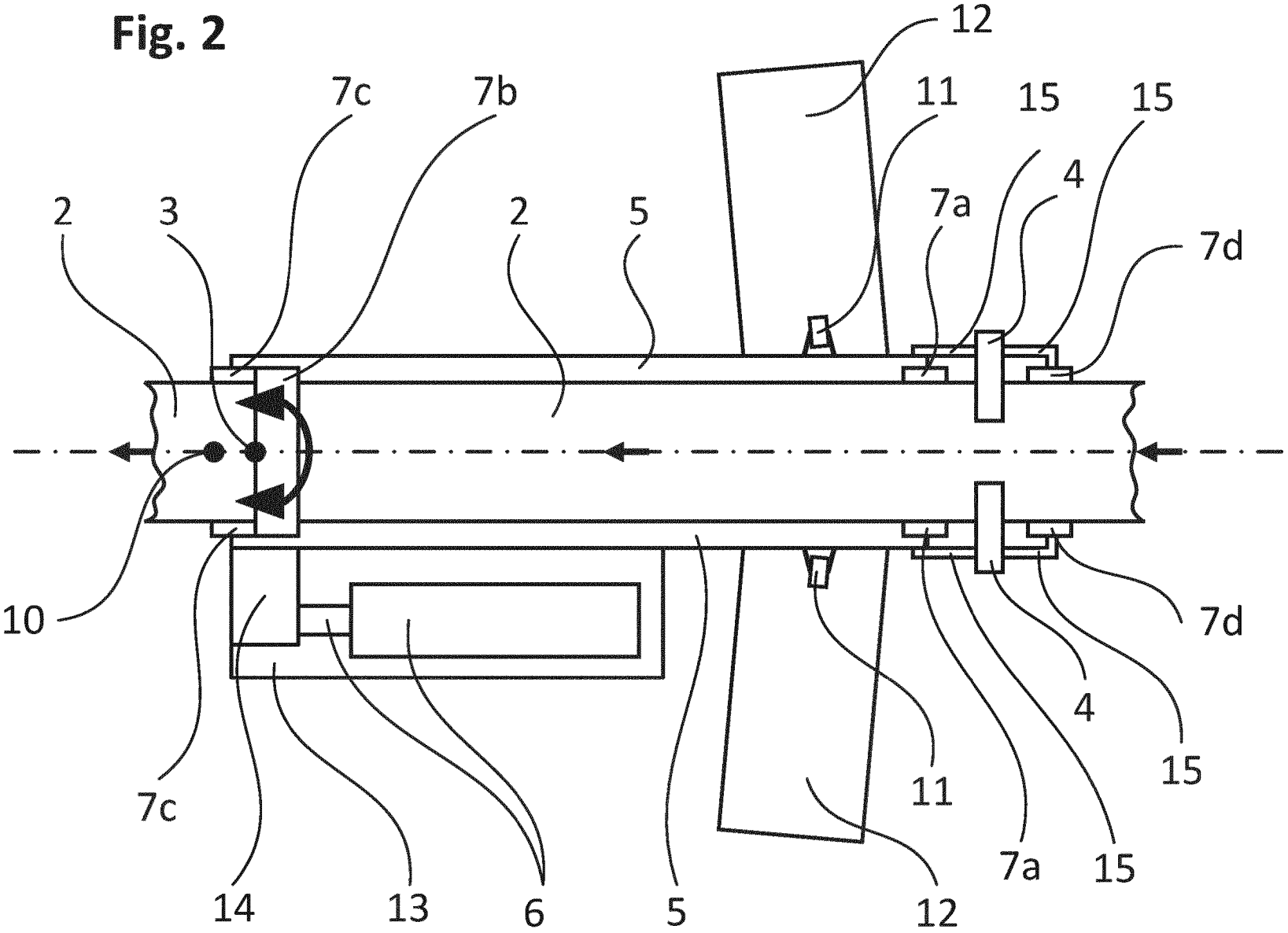
FIG. 2 is a schematic top view of the apparatus from FIG. 1.
Figure 3:
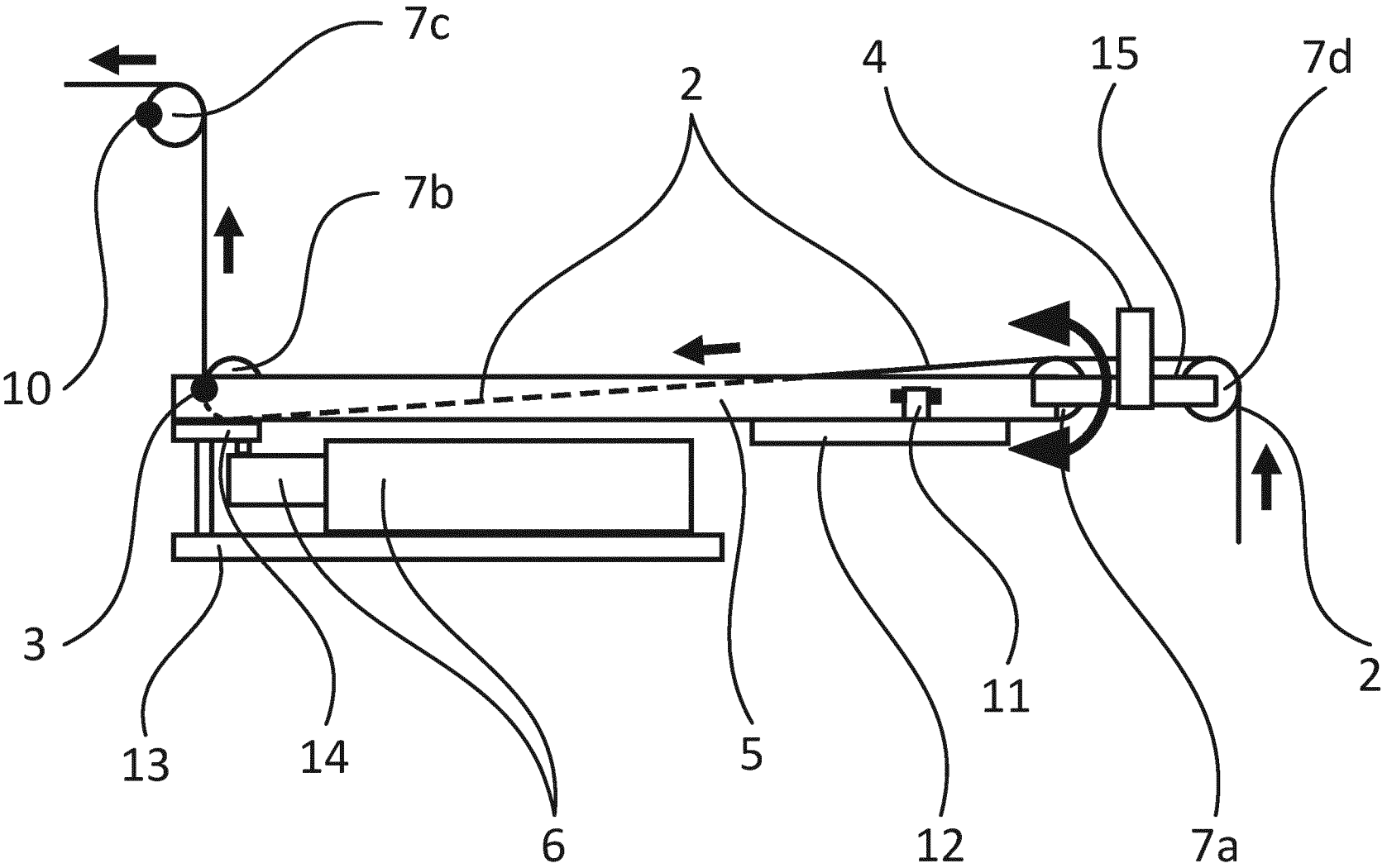
FIG. 3 is a schematic side view of the apparatus from FIG. 1 and FIG. 2.

FIG. 1 illustrates a perspective view of an apparatus for unwinding a web roll wound in a shifted manner, or for removing loose webs from containers, said apparatus in its entirety from now on being called guiding apparatus 100. FIG. 2 illustrates a schematic top view of the guiding apparatus 100. FIG. 3 illustrates a schematic side view of the guiding apparatus 100. Each of the figures shows the web 2 and the guiding device 5 comprising a base plate with two opposing support rails attached to it. One guiding element 7*a* is mounted between the support rails at the entry side of the guiding device 5 and one guiding element 7*b* is mounted between the support rails at the exit side of the guiding device 5. Above the guiding element 7*b* at the exit side of the guiding device 5 another guiding element 7*c* is mounted at the infeed point 10. Two wheels 11 are mounted to the support rails of the guiding device 5 and rest on a holder 12 at the entry side of the guiding device 5. The guiding device 5 is pivotally mounted on a holder 13 at the centration point 3. The actuator 6 is mounted to the holder 13 and is connected to the guiding device 5 with a lever element 14. At the entry side of the guiding device 5 a pivoting frame 15 is pivotably mounted to the support rails of the guiding device 5. The sensor arrangement 4 and the guiding element 7*d* are mounted to the pivoting frame 15. All of the guiding elements 7*a*, 7*b*, 7*c*, 7*d* are illustrated as idler rollers that can rotate around their longitudinal axis.

Figure 4A:
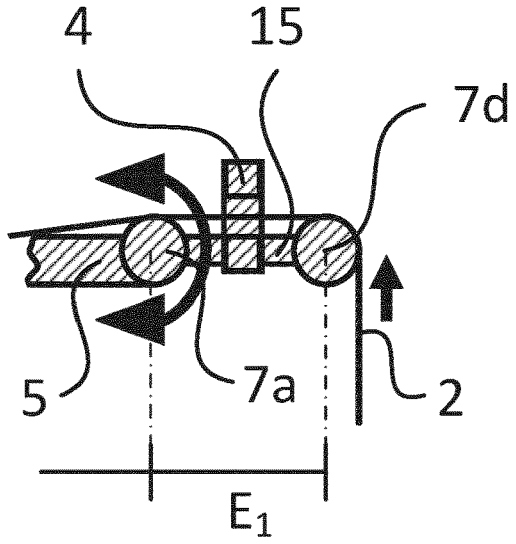
FIG. 4*a* and FIG. 4*b* and FIG. 4*c* are schematic side views of the pivoting frame that is mounted at the entry side of the guiding device illustrated in FIG. 1 and FIG. 2 and FIG. 3 in three different positions.
Figure 4B:
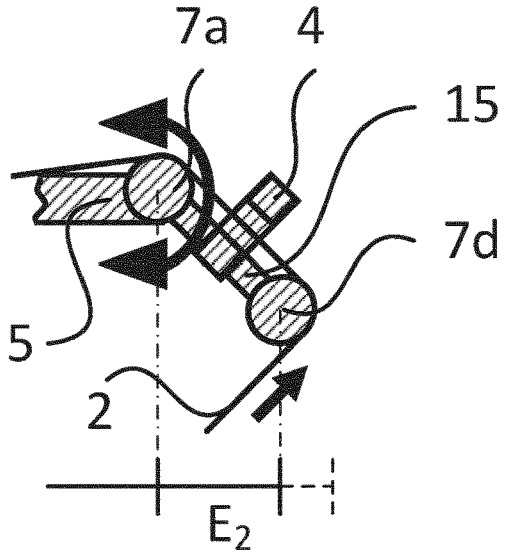
Figure 4C:
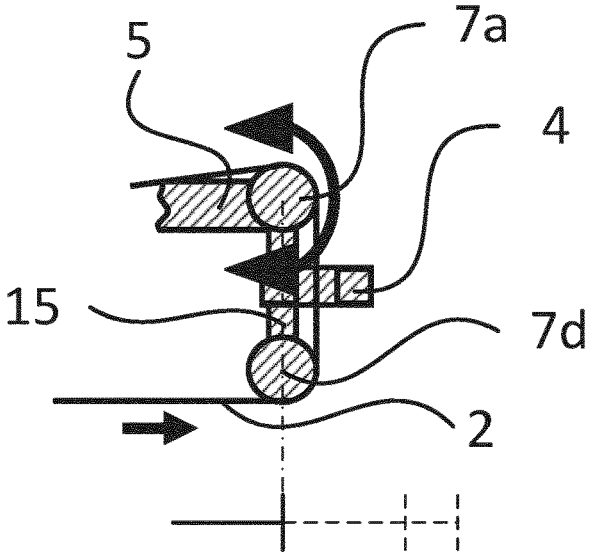

FIG. 4*a*, FIG. 4*b* and FIG. 4*c* illustrate side views of the pivoting frame 15 mounted to the entry side of the guiding device 5 in three different positions. Each of the figures shows the entry side of the guiding device 5, the web 2, the guiding element 7*a* at the entry side of the guiding device 5, the pivoting frame 15 mounted to the guiding device 5, the guiding element 7*d* and the sensor arrangement 4 mounted on the pivoting frame 15.

Figure 5A:
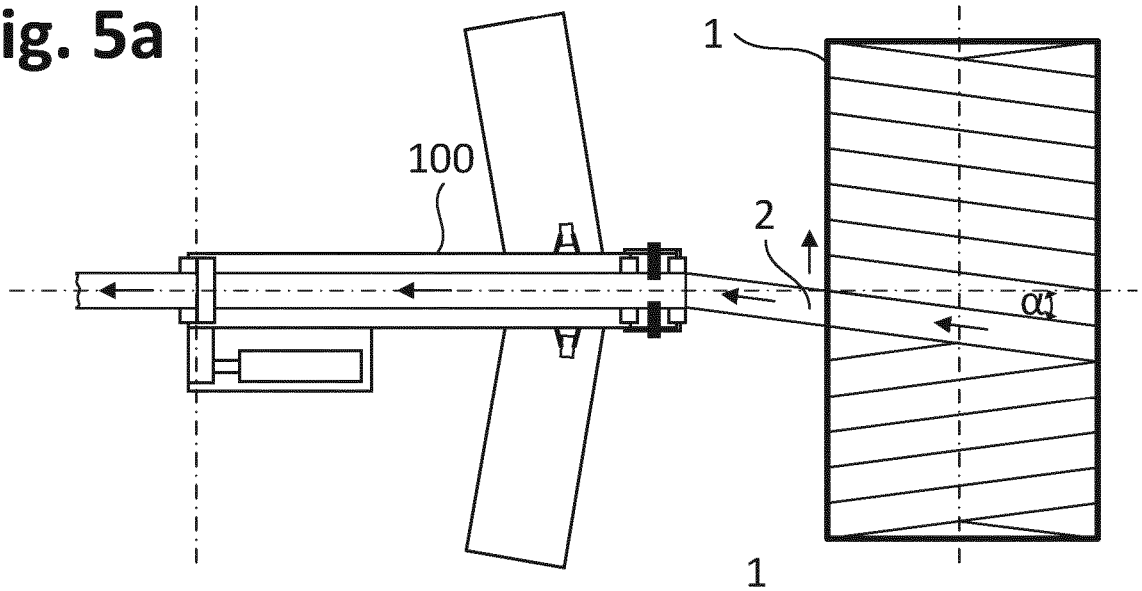
FIG. 5*a* and FIG. 5*b* and FIG. 5*c* are schematic top views of the apparatus from FIG. 1, FIG. 2 and FIG. 3 during the unwinding of a web roll wound in a shifted manner at three different points of time.
Figure 5B:
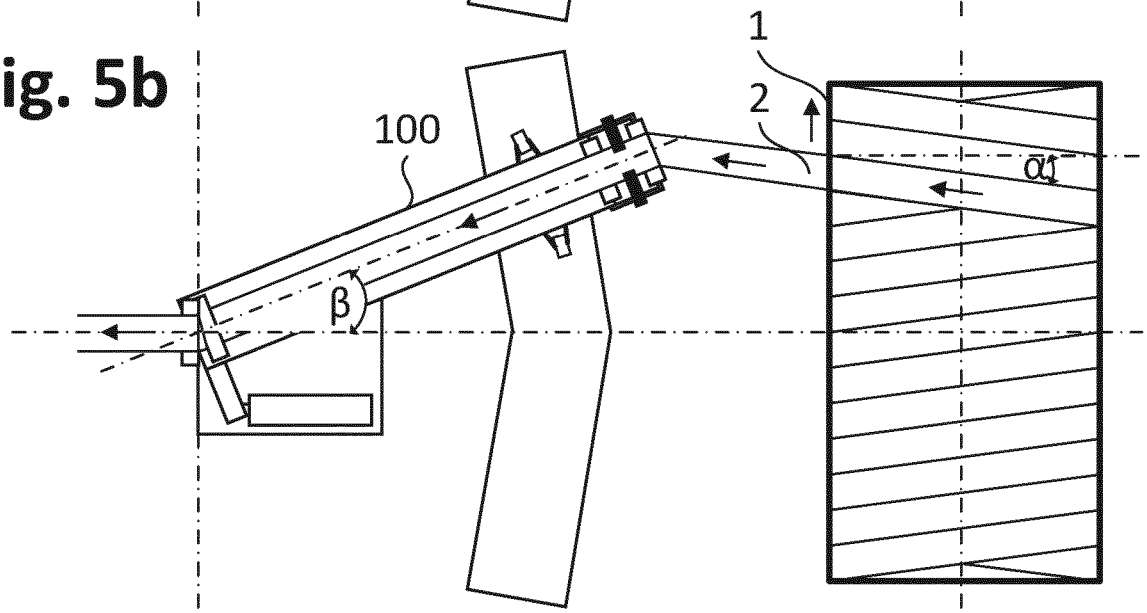
Figure 5C:
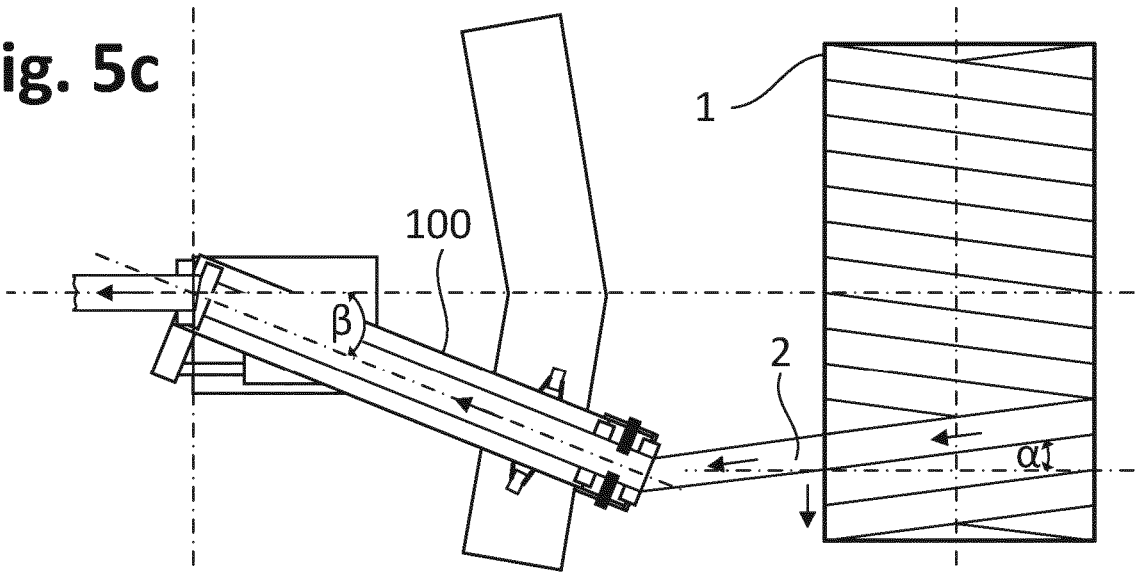

FIG. 5*a*, FIG. 5*b* and FIG. 5*c* illustrate a top view of the guiding apparatus 100 during the unwinding of a spirally wound web roll 1 at three different points of time. Each of the figures shows the unwinding apparatus 100 with its deflection angle (β), the web roll 1 and the web 2 with its winding angle (α) on the web roll 1.

As illustrated in FIG. 5*a*, FIG. 5*b* and FIG. 5*c* the web 2 leaves the spirally wound web roll 1 during unwinding in a constantly shifting path of the web with an angle to a transverse axis of the web roll 1 equal to its winding angle (α) on the web roll 1. The shifting direction of the path of the web changes from left to right or from right to left (respectively bottom to top or top to bottom in the figures) as soon as a whole layer of the web roll 1 has been unwound.

The web 2 enters the guiding apparatus 100 from a direction perpendicular to the plane defined by the longitudinal axes of the guiding element 7*d* and the guiding element 7*a*. The web 2 runs around the guiding element 7*d* at the entry side of the pivoting frame 15 and enters the guiding device 5 at the guiding element 7*a*. The sensor arrangement 4 measures the current position of the web 2 at the pivoting frame 15 between the two guiding elements 7*d*, 7*a* and transmits a signal to a controller that compares the actual value with a defined nominal value and sends a correction signal to the actuator 6. The actuator 6 then moves the guiding element 5 in accordance with the correction signal so that the entry side of the guiding device 5 follows the shifting path of the web through pivoting motions around the centration point 3.

Depending on the current deflection angle (β) of the guiding device 5 the inclination of the guiding element 7*d* in respect to the path of the web creates a transverse force on the web 2. This transverse force rotates the direction of the path of the web into one line with the longitudinal axis of the guiding device 5. In the process the web 2 becomes slightly twisted upstream to the guiding element 7*d* due to the rotation of the path of the web. The web 2 then runs over the guiding element 7*a* at the entry side of the guiding device 5 to the guiding element 7*b* at its exit side.

The web 2 runs around the guiding element 7*b* and leaves the guiding device 5 in perpendicular direction upwards towards the guiding element 7*c* at the infeed point 10. The guiding element 7*c* has a constant location and orientation in respect to the web roll 1. The redirection of the path of the web in perpendicular direction and the current inclination of the guiding element 7*c* in respect to the path of the web through the guiding device 5 translates the current deflection angle (β) of the guiding device 5 into a twisting of the web 2 between the guiding element 7*b* and the guiding element 7*c*. The web 2 finally leaves the guiding apparatus 100 at the infeed point 10 whereby the twisted path of the web is translated into a linear and in one direction constant movement downstream of the infeed point 10.

The twisting of the web 2 at the entry and exit side of the guiding device 5 puts increased stress on the material depending on the distance between the web roll 1 and the guiding element 7*d* and also depending on the angle in which the direction of the path of the web has to be rotated and the distance between the guiding element 7*b* and the guiding element 7*c*. It is therefore beneficial to position the guiding element 7*d* at an appropriate distance to the web roll 1 and to mount the guiding element 7*b* in an appropriate distance to the guiding element 7*c* to avoid tearing of the web 2. In practice a distance of five times the webs 2 width at β=0 at the entry side has proven to be suitable for a web 2 made of rather sensitive nonwoven with a grammage from about 5 g/m$^2$ to about 60 g/m$^2$. For the exit side a distance of four times the webs width has proven suitable.

Furthermore, the rotation of the orientation of the path of the web creates a pulling force on the web 2 that increases with the size of the rotation angle. The effective rotation angle at the exit side of the guiding device 5 is equal to the current deflection angle (β) at any given point of time. The effective rotation angle at the entry side can be calculated by adding up the current deflection angle (β) and the current winding angle (α) of the web 2 on the web roll 1. If the winding angle (α) and the length of the web roll 1 are considered to be constant values the maximum deflection angle ($\beta_{max}$) of the guiding device 5 will increase with an increasing distance of the guiding element 7*d* in respect to the web roll 1 and will decrease with an increasing length of the guiding device 5 plus its length extension (E) by the pivoting frame 15 as projected into the plane of the guiding device 5. Examples of length extensions $E_1$ and $E_2$ are illustrated in FIGS. 4*a* and 4*b*. As can be seen in FIG. 4*c* the projected length extension may become zero at a 90° angle. Since as mentioned above the distance of the guiding element 7*d* to the web roll 1 should be chosen appropriately, the length of the guiding device 5 plus its length extension (E) by the pivoting frame 15 may become a relevant variable for designing the guiding apparatus 100 in sight of a maximum desired rotation angle ($\beta_{max}+\alpha_{max}$).

For example with a web 2 made of nonwoven with a width of 0.1 m and with a grammage of 5 g/m$^2$ to about 60 g/m$^2$ and with a maximum winding angle ($\alpha_{max}$) of 15° on a spirally wound web roll 1 a length of 1.3 m of the guiding device 5 plus its length extension (E) by the pivoting frame 15 had proven suitable. With a distance of 0.5 m between the guiding element 7*d* and the web roll 1 the maximum deflection angle ($\beta_{max}$) never exceeded a value of 30° keeping the rotation angle under 45° at all times. The length of the guiding device for other values can easily be calculated by the following formula:

$$a = \tan(\alpha_{max}) * \frac{b}{\sin(\beta_{max})} + \frac{1}{2} * \frac{L}{\sin(\beta_{max})}$$

a=length of the guiding device 5 plus its length extension (E) by the pivoting frame 15 b=distance between the guiding element 7*d* mounted to the pivoting frame 15 and the web roll 1 for β=0

L=length of the web roll 1

$\alpha_{max}$=maximum winding angle of the web 2 on the spirally wound web roll 1

$\beta_{max}$=maximum deflection angle of the guiding device 5

To ensure that the friction between the guiding element 7*d* at the entry side of the pivoting frame 15 and the web 2 is sufficient for the rotation of the direction of the path of the web a correct positioning of the guiding device 5 in respect to the web roll 1 may be preferred. For example, if the web 2 would enter the guiding device 5 in the same plane as defined by the longitudinal axes of the guiding element 7*d* and of the guiding element 7*a* the web would at a finite friction coefficient slide over the guiding element 7*d* with no rotation being achieved. A positioning of the guiding device 5 above the web roll 1 or container has therefore proven to be favorable. This way the web 2 enters the unwinding apparatus 100 perpendicular to the plane defined by the longitudinal axes of the guiding element 7*d* and the guiding element 7*a* and the contact surface between the web 2 and the guiding element 7*d* is about one quarter of the guiding elements 7*d* surface area.

As illustrated in FIG. 4*a* and FIG. 4*b* and FIG. 4*c* the pivoting frame 15 allows an alternative positioning of the guiding device 5 while keeping a favorable angle of entry of the web 2 into the guiding apparatus 100. Since the sensor arrangement 4 is mounted to the pivoting frame 15 as well there is no need for an additional adjustment of the orientation of the sensor arrangement 4 if the pivoting frame 15 is pivoted.

Another possibility for a more flexible positioning of the guiding device 5 in respect to the web roll 1 lies with alternative guiding routes of the web 2 around the guiding elements 7*a*, 7*b*, 7*c*, 7*d*. The guiding route that has been illustrated in each of the figures consists of guiding the path of the web above the first two guiding elements 7*d*, 7*a*, then guiding it under the third guiding element 7*b* and then guiding it above the last guiding element 7*c*. It is possible to change this guiding route in a multitude of ways such as different paths under and above the guiding elements 7*a*, 7*b*, 7*c*, 7*d* or by adding additional guiding elements to the guiding apparatus 100. For example if the guiding device 5 is supposed to be positioned beneath the web roll 1 and the infeed point 10 is located at the same level as the web roll 1 or container the web 2 can be guided under the first guiding element 7*d* then above the second guiding element 7*a* then under the third guiding element 7*b* and finally above the last guiding element 7*c*. It should be noted however that the web 2 in this configuration is angled to the plane defined by the longitudinal axes of the guiding element 7*d* and the guiding element 7*b* and the orientation of the sensor arrangement 4 has to be adjusted accordingly.

With a guiding route as illustrated in FIG. 1, FIG. 2 and FIG. 3 the pulling forces inside the web 2 possess a force component directed perpendicular to the plane defined by longitudinal axes of the guiding element 7*a* at the entry side of the guiding device 5 and the guiding element 7*b* at the exit side of the guiding device. The arc-like pivoting motions of the guiding device 5 as illustrated in FIG. 5*a* and FIG. 5*b* and FIG. 5*c* now cause small periodic changes in the distance of the guiding element 7*d* in respect to the web roll 1.

Likewise, there are small fluctuations in the pulling forces inside the web 2 and their vertical force component depending on the current deflection angle (β) of the guiding device 5. These fluctuations can cause the guiding device 5 to swing and vibrate especially at higher pivoting speeds. In order to stabilize the guiding device 5 two wheels 11 are mounted to the support rails of the guiding device 5 and rest on top of a holder 12 located in close proximity to the entry side of the guiding device 5. As a side effect the stress on the material in the mounting of the guiding device 5 on the holder 13 at its exit side is reduced as well.

According to the functional principle of the guiding apparatus 100 a wide variety of types of guiding elements 7*a*, 7*b*, 7*c*, 7*d* can be used. The question which type to choose only becomes important once the friction between the guiding elements 7*a*, 7*b*, 7*c*, 7*d* and the web 2 is considered to be an issue. For example using passive idler rollers has proven to be sufficient for a web 2 made of nonwoven. For materials of greater sensitivity however it is possible to use active guiding elements such as motorized rollers. Likewise, for materials of lower sensitivity using passive non-rotating elements like rods can become an option. In case of materials of even lower sensitivity it can be considered an option to design the guiding apparatus 100 without any guiding elements at all and use two spaced plates as guiding device 5 instead.

It is supposed that the present invention is not restricted to any form of realization described previously and that some modifications can be added to the presented example of fabrication without reappraisal of the appended claims. For example, the present invention has been described referring to web rolls, but it is clear that the invention can be applied to containers of loose web material for instance or to spirally wound web rolls in particular.

The invention claimed is:

1. A method of guiding a web (2) with a shifting path of the web to a centration point (3) comprising the steps of a. providing the web (2) with a shifting path of the web from a source of the web, b. measuring the position and/or orientation of said web (2) by a sensor arrangement (4) that is located upstream of said centration point (3), c. guiding said web (2) to said centration point (3) in accordance with the measurement results of step b, wherein said guiding of the web (2) to the centration point (3) is conducted by at least one guiding device (5), said at least one guiding device being pivotably mounted substantially at the centration point (3), characterized in that the pivoting of the guiding device (5) is controlled by a control circuit, said control circuit comprising at least one actuator (6) and the sensor arrangement (4), characterized in that said centration point (3) has a substantially constant position in respect of the source of the web and in that the measurement of step b is conducted upstream of said centration point (3) at an entry side of the guiding device (5) and/or between the guiding device (5) and a web roll (1) and/or at the web roll (1), and wherein the sensor arrangement (4) is adapted to pivot around an axis at the entry side of the guiding device (5).

2. The method according to claim 1, wherein said shifting path of the web is adjusted to a substantially linear path of the web and to a substantially in orientation constant path of the web downstream of said centration point (3).

3. The method according to claim 1, wherein the source of the web is a web roll (1) or container and wherein said web (2) comprises a material selected from the group of films, papers, textiles, nonwovens and super absorbent papers.

4. An apparatus for guiding a web (2) with a shifting path of the web from a source of the web to a centration point (3) comprising a guiding device (5) pivotably mounted substantially at a centration point (3), said centration point having a substantially constant position in respect of the source of the web (2), said guiding device being adapted to guide said web (2) to said centration point (3), characterized in that the pivoting of the guiding device (5) is controlled by a control circuit, said control circuit comprising at least one actuator (6) and a sensor arrangement (4) that is located upstream of said centration point (3) and in that said sensor arrangement (4) measures the position and/or orientation of the web (2) upstream of said centration point (3), wherein the sensor arrangement (4) measures the shifting of the path of the web (2) at the entry side of the guiding device (5) and/or between the guiding device (5) and a web roll (1) and/or at the web roll (1), and wherein the sensor arrangement (4) is adapted to pivot around an axis at the entry side of the guiding device (5).

5. The apparatus according to claim 4, wherein the apparatus is adapted to guide said web (2) downstream of the centration point (3) in substantially perpendicular direction to an infeed point (10) and the path of the web is adjusted to a substantially linear and in orientation constant movement downstream of said infeed point.

6. The apparatus according to claim 5, wherein at the infeed point (10) a guiding element (7*c*) is mounted.

7. The apparatus according to claim 6, wherein the guiding element (7*c*) comprises an idler roller or a rod.

8. The apparatus according to claim 4, wherein upstream of the sensor arrangement (4) at least one guiding element (7*d*) is pivotably mounted.

9. The apparatus according to claim 8, wherein the sensor arrangement (4) and the at least one guiding element (7*d*) are mounted to the same pivoting frame (15) that can be pivoted around an axis at the entry side of the guiding device (5).

10. The apparatus according to claim 8, wherein the at least one guiding element (7*d*) comprises an idler roller or rod.

11. The apparatus according to claim 4, wherein the guiding device (5) comprises at least two guiding elements (7*a*, 7*b*) of which one guiding element (7*a*) is mounted to the guiding device (5) at its entry side and one guiding element (7*b*) is mounted to the guiding device (5) at its exit side.

12. The apparatus according to claim 11, wherein the at least two guiding elements (7*a*, 7*b*) comprise at least two idler rollers or rods.

13. The apparatus according to claim 4, wherein at least one web guiding system for fine tuning of the path of the web is mounted downstream of the centration point (3).

14. The apparatus according to claim 4, wherein said web (2) comprises a material selected from the group of films, papers, textiles, nonwovens and super absorbent papers.

* * * * *